US010881899B2

(12) United States Patent
Barry

(10) Patent No.: US 10,881,899 B2
(45) Date of Patent: Jan. 5, 2021

(54) EXERCISE DEVICE AND METHOD OF USE

(71) Applicant: Edwin Barry, Voorhees, NJ (US)

(72) Inventor: Edwin Barry, Voorhees, NJ (US)

( * ) Notice: Subject to any disclaimer, the term of this patent is extended or adjusted under 35 U.S.C. 154(b) by 23 days.

(21) Appl. No.: 16/400,403

(22) Filed: May 1, 2019

(65) Prior Publication Data

US 2019/0336820 A1 Nov. 7, 2019

Related U.S. Application Data

(60) Provisional application No. 62/762,379, filed on May 3, 2018.

(51) Int. Cl.

| | |
|---|---|
| ***A63B 23/02*** | (2006.01) |
| ***A63B 23/00*** | (2006.01) |
| ***A63B 21/00*** | (2006.01) |

(52) U.S. Cl.

CPC .... *A63B 23/0238* (2013.01); *A63B 21/00185* (2013.01); *A63B 21/159* (2013.01); *A63B 21/4011* (2015.10); *A63B 21/4035* (2015.10); *A63B 2023/006* (2013.01)

(58) Field of Classification Search

CPC ..... A61G 7/00; A61G 7/10; A61G 7/1001; A61G 7/1017; A61G 7/1019; A61G 7/1038; A61G 7/104; A61G 7/1049; A61G 1/003; A61G 1/013; A61H 1/02; A61H 1/0218; A61H 1/0222; A61H 2205/08; A61H 2205/081; A61H 1/0292; A63B 21/00185; A63B 21/068; A63B 21/159; A63B 21/4011; A63B 21/4023; A63B 21/4033; A63B 21/4035; A63B 21/4039; A63B 21/4045; A63B 21/4047; A63B 23/02; A63B 23/0233; A63B 23/0238; A63B 23/025

USPC ..... 482/144

See application file for complete search history.

(56) References Cited

U.S. PATENT DOCUMENTS

| | | | | |
|---|---|---|---|---|
| 3,354,879 | A | 11/1967 | Briggs | |
| 4,362,151 | A | 12/1982 | Cottrell | |
| 4,489,713 | A | 12/1984 | Latenser | |
| 4,531,514 | A | 7/1985 | McDonald | |
| 4,602,619 | A | 7/1986 | Wolf et al. | |
| 5,203,755 | A * | 4/1993 | Kaiser | A61H 1/0218 482/142 |

(Continued)

FOREIGN PATENT DOCUMENTS

| | | |
|---|---|---|
| DE | 19608524 C1 | 4/1997 |
| WO | WO2017/137963 A1 | 8/2017 |

*Primary Examiner* — Garrett K Atkinson
*Assistant Examiner* — Zachary T Moore
(74) *Attorney, Agent, or Firm* — Michael J. Brown

(57) ABSTRACT

An exercise device for lifting up the lower back by raising a user's knees upward from a resting position. An elongated fixed strut extends upward from the base, and a carriage is placed on the elongated fixed strut, capable of moving on the elongated fixed strut between a lower position and an upper position relative to the elongated fixed strut. Knee supports are attached to the carriage, allowing a user to place their knees on the knee supports. As the carriage moves upward on the elongated fixed strut, the user's knees are lifted upward, thereby causing the hips and pelvis to rise, producing a flexion of the lower back. The upward movement of the hips and pelvis produces the distraction of the lumbar spinal segments.

8 Claims, 13 Drawing Sheets

(56) References Cited

U.S. PATENT DOCUMENTS

| | | | | |
|---|---|---|---|---|
| 5,387,186 | A | 2/1995 | Edland | |
| 6,443,916 | B1 | 9/2002 | Ilan | |
| 6,986,181 | B2 | 1/2006 | Murphy et al. | |
| 7,651,446 | B1 * | 1/2010 | Eschenbach | A63B 23/0216 482/52 |
| 7,931,574 | B2 | 4/2011 | Bracci | |
| 8,287,439 | B2 | 10/2012 | Evans et al. | |
| 9,358,174 | B1 | 6/2016 | Gallo | |
| 9,358,424 | B1 | 6/2016 | Childress | |
| 9,616,284 | B1 * | 4/2017 | Aganyan | A61H 1/0229 |
| 2008/0200319 | A1 * | 8/2008 | Fong | A61H 1/0292 482/144 |
| 2010/0331156 | A1 * | 12/2010 | Chang | A63B 23/0211 482/144 |
| 2013/0331238 | A1 * | 12/2013 | Ellis | A63B 21/06 482/97 |
| 2014/0121070 | A1 * | 5/2014 | Ellis | A63B 22/205 482/96 |
| 2015/0151158 | A1 * | 6/2015 | Ellis | A63B 21/159 482/142 |
| 2015/0367173 | A1 * | 12/2015 | Ellis | A63B 21/00181 482/127 |
| 2016/0022527 | A1 | 1/2016 | Liran et al. | |

* cited by examiner

EXERCISE DEVICE AND METHOD OF USE

PRIORITY

This application claims domestic benefit from pending provisional application no. 62/762,379, filed May 3, 2018.

FIELD OF INVENTION

The invention is in the field of personal fitness devices and machines to assist in stretching, specifically stretching the lower back.

BACKGROUND

It is estimated that approximately 80 million people in just the United States alone will suffer from lower back pain in any given year. This pain may arise from a host of common ailments affecting the lower back to include degenerative arthritis affecting the discs and facet joints, disc degeneration, facet syndrome, spinal stenosis, strain/sprain, mechanical lower back dysfunction, intervertebral disc bulging and protrusion, as well as sacroiliac disorders.

These syndromes are included in the general classification of musculoskeletal disorders, and as such comprise about one third of all reasons for a visit to one's primary medical doctor. Typically, the treatment for these conditions consists of prescriptions for NSAIDs (non-steroidal anti-inflammatories) or worse, opioids like, oxycontin, or hydrocodone. In fact, lower back pain has become the leading reason for physicians prescribing these dangerous medications, which have partially led to the current opioid epidemic affecting the United States.

The physician may refer the patient for physical therapy if they are still in pain, but many patients who are still experiencing disabling pain may be unable to do stretching or strengthening exercises while this pain is still a factor. The patient may also be referred for advanced imaging or other testing, as well as a consultation with an orthopedist or neurosurgeon for surgical evaluation, and scheduled surgery. Surgery is a last resort, affects a small percentage of this population, and has generally found to be effective in a very small percentage of cases. Most of these patients, over time, will respond favorably to some form of conservative treatment such as chiropractic and physical therapy, enhanced by some form of active exercises to be performed by the patient at home, for the long course.

The focus of such an exercise program has primarily been to stretch or open the contiguous articular structures of the spine, with emphasis on the discs and facet joints, for the purpose of relieving gravitational forces and physical stress, and also to enhance circulatory perfusion for facilitation of blood borne nutrients into these joints to facilitate healing. Over the years, many devices have been designed to provide such "stretching", or traction, some for clinical use, and some for home use. These prior art devices include, static traction devices such as gravity inversion tables, as well as more dynamic devices such as decompression tables. Home use devices allow for sufferers to duplicate some of this action with a unit requiring the user to achieve this effect with user interaction with the device. Many of these devices fall short in providing truly all-encompassing dynamic movement for the user which movement would be maximally therapeutic.

Prior art disclosures only provide limited relief to lower back pain sufferers. U.S. Pat. No. 8,287,439 discloses a device that only lifts vertically the hips and pelvis without any concomitant flexion of the lower back. US Pub. 20160022527 discloses a device that simply produces an oscillation of the legs, with the legs and hips in a flexed raised position, without any significant flexion of the lower back. U.S. Pat. No. 9,358,424 discloses a device that essentially only lifts the hips and pelvis vertically, with the knees only in a fixed position for pelvic flexion, producing minimal or no flexion in the lower back. U.S. Pat. No. 7,931,574 and U.S. Pat. No. 9,358,174 disclose devices that are only suitable for clinical use and could not be adapted for home use.

The present invention addresses the failings of prior art devices by providing a home exercise device for support and amelioration of the pain associated with most, if not all, of the most commonly suffered ailments known to produce acute and chronic lower back pain in the general patient population. The rationale for the design of the device originated from a desire to provide a mechanism that would be comfortable for the user for home use, with some portability, but most importantly, that would combine, dynamically, the two fundamental movements essential for supporting healing and rejuvenation in the lower back, i.e. flexion and distraction of the lumbar vertebrae.

Flexion of the lumbar spinal segments has been found to be the direction of preferred movement for the lower back for the majority of lower back pain sufferers with some exceptions. Distraction, or separation of the lumbar vertebrae is essential for alleviating gravitational stress, but more importantly, allows for the osmotic transport of vital oxygenated blood and nutrients from the marrow of the vertebral body across the vertebral endplate and into the annular fibers and nucleus of the disc. This process maintains the hydrostatic properties of the disc, which is essential for maintenance of its structural integrity and viability. The present invention was designed to produce these two motions simultaneously in a dynamic manner, controlled by the patient and performed in the comfort of his/her own home.

SUMMARY

An exercise device for lifting up the lower back by raising a user's knees upward from a resting position. An elongated fixed strut is attached to a base, where the elongated fixed strut extends upward from the base. A carriage is placed on the elongated fixed strut, capable of moving on the elongated fixed strut between a lower position and an upper position relative to the elongated fixed strut. Knee supports are attached to the carriage, allowing a user to place their knees on the knee supports. As the carriage moves upward on the elongated fixed strut, the user's knees are lifted upward, thereby causing the hips and pelvis to rise, producing a flexion of the lower back. The upward movement of the hips and pelvis produces the distraction of the lumbar spinal segments. By positioning the hips and pelvis directly beneath the knee support, the fixed angle of the carriage (between 65 and 85 degrees from the base or surface) induces flexion of the lumbar segments concomitant with the distraction.

In a preferred embodiment, the device includes a pivoting arm attached to the base, where the pivoting arm has an upper end and a lower end, where the lower end is attached to the base, and the upper end supports a pulldown bar. The pulldown bar preferably has a handle, allowing a user to hold and pull on the handle, thereby bringing the pulldown bar closer to the user. An elongated link is attached to the pivoting arm at one end and to the carriage at another end, and as the user causes the pulldown bar to move, the link causes the carriage to move upward on the elongated fixed strut. The ergonomic function of the link mechanism is designed to minimize the user effort in causing the carriage to rise via pulling on the handles.

DETAILED DESCRIPTION

Figure 1:
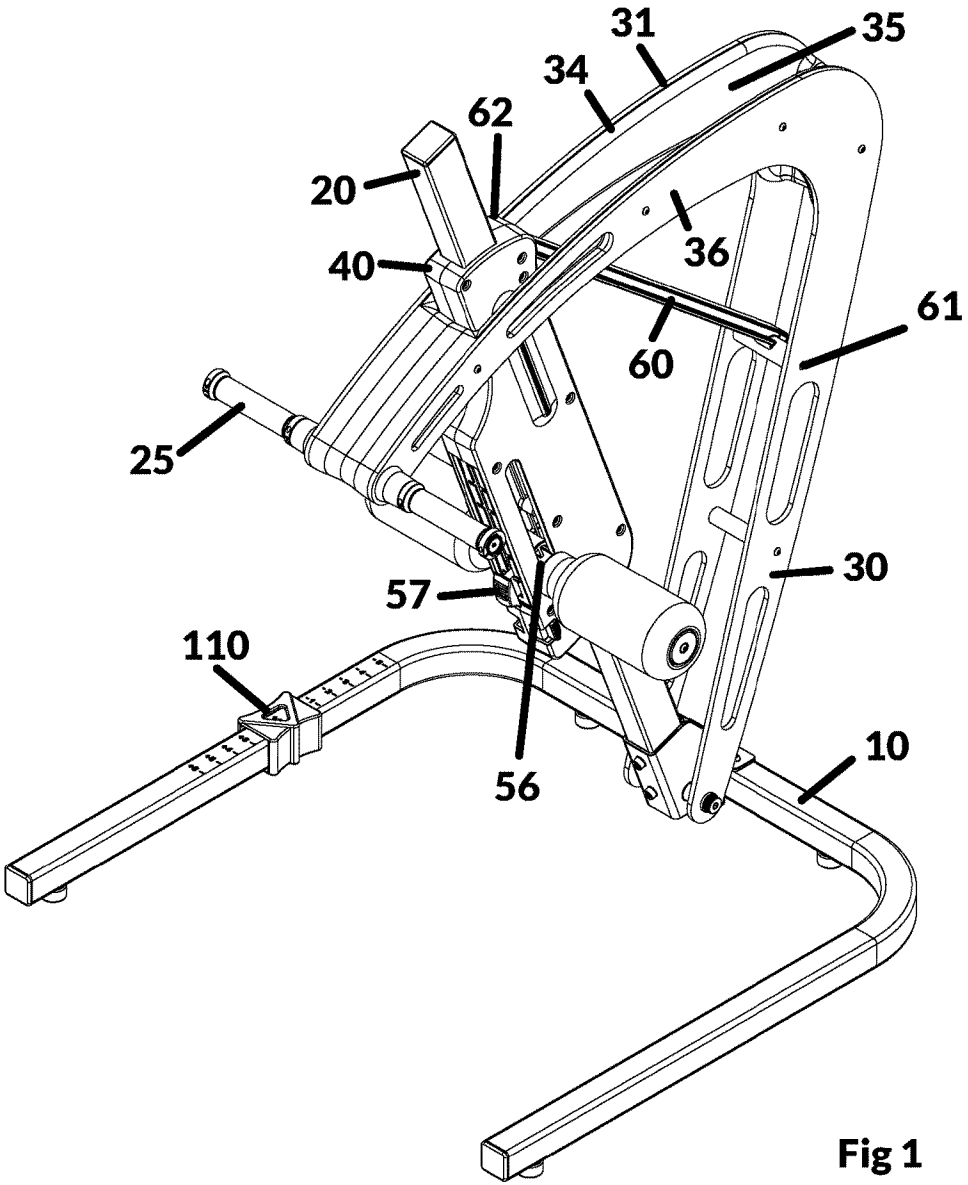
FIG. 1 is a perspective view of a preferred embodiment in a down or resting position.
Figure 2:
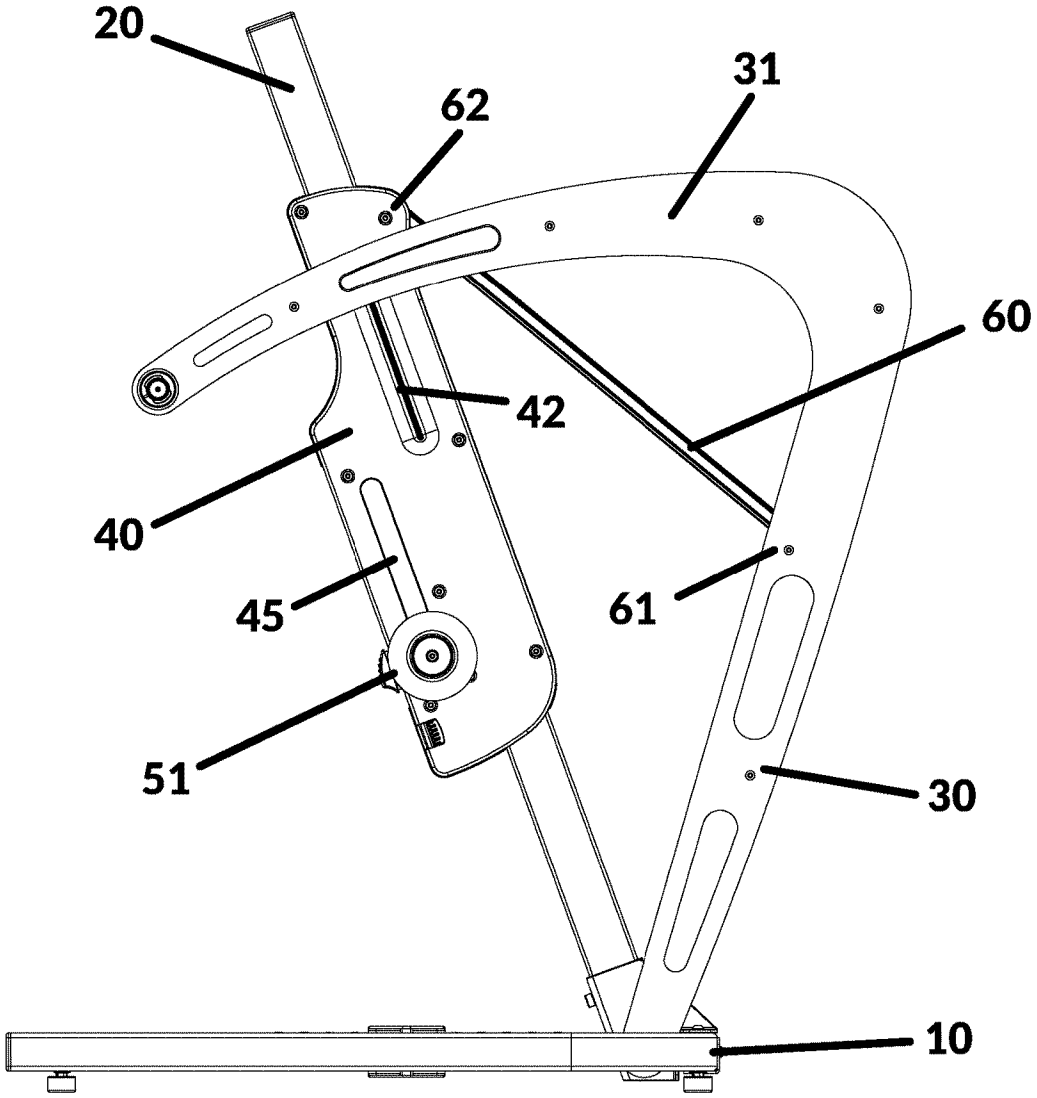
FIG. 2 is a side view of the embodiment in FIG. 1.
Figure 3:
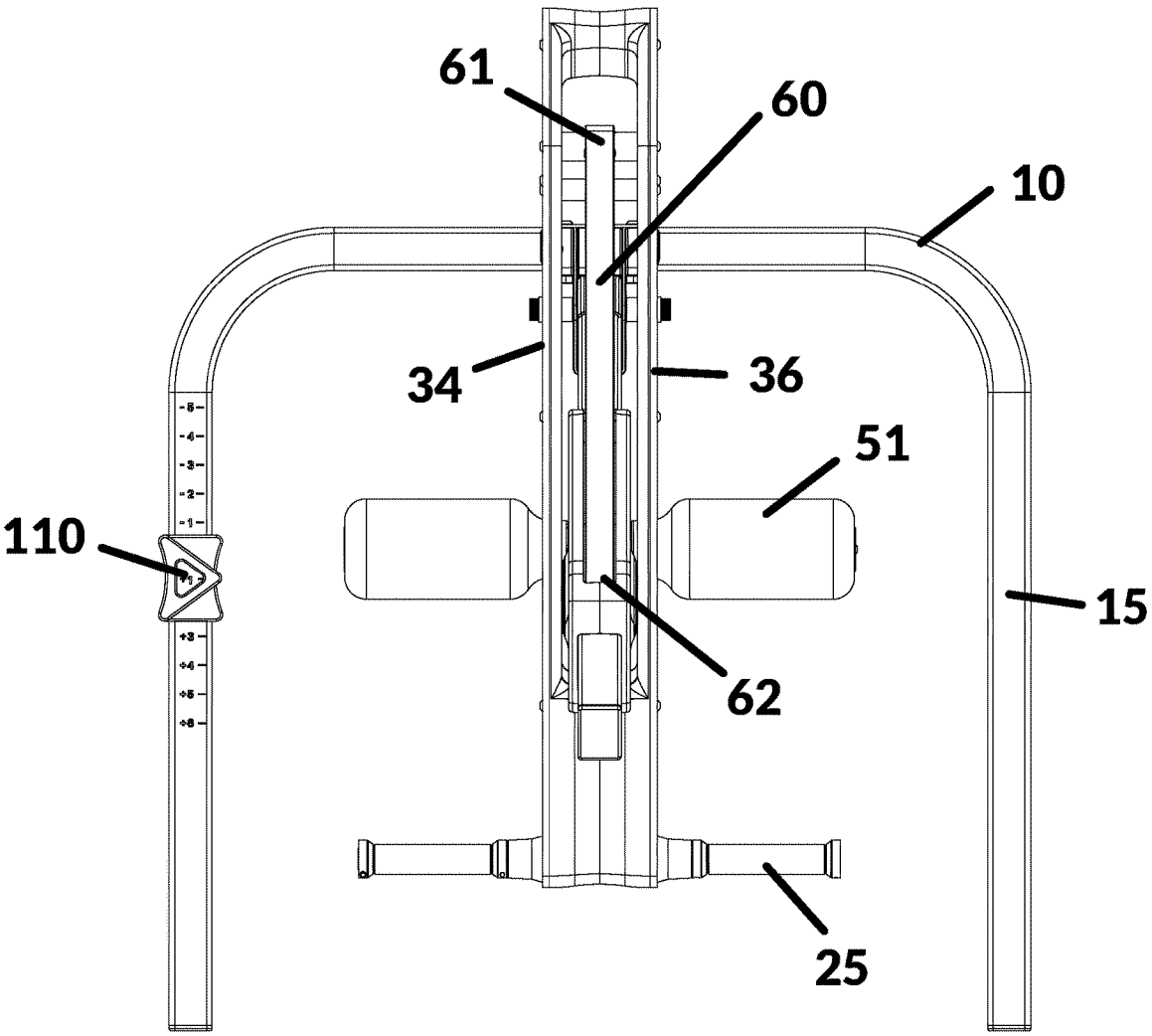
FIG. 3 is a top view of the embodiment in FIG. 1.
Figure 4:
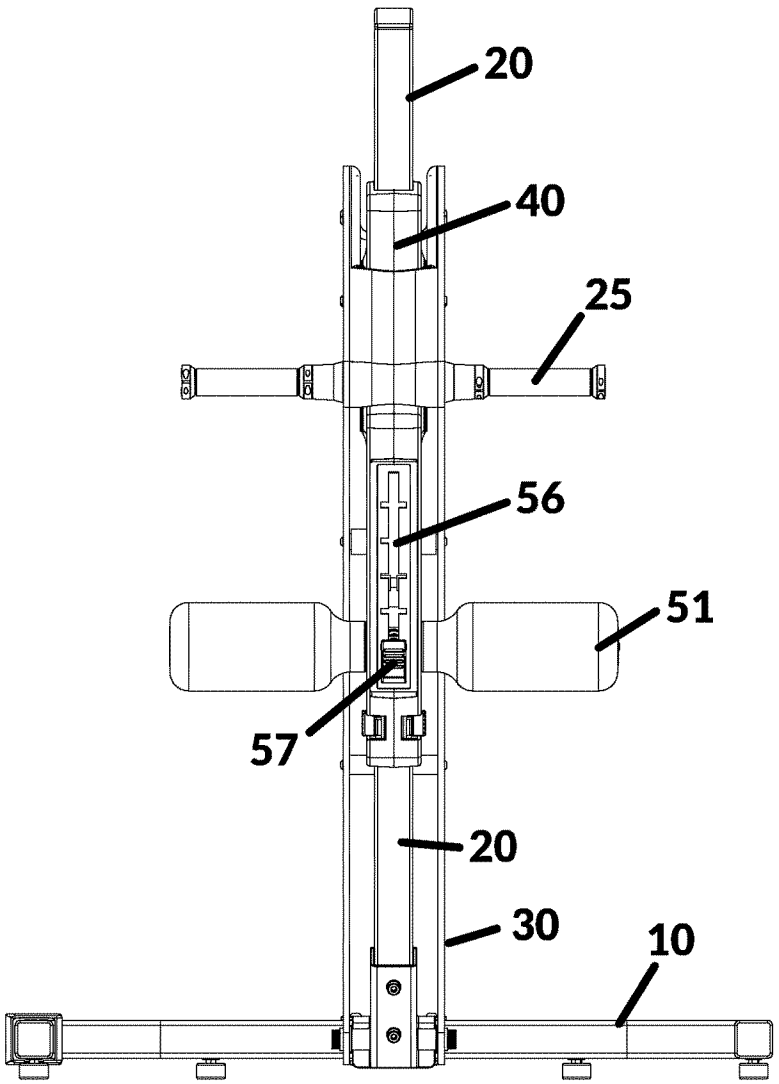
FIG. 4 is a front view of the embodiment in FIG. 1.
Figure 5:
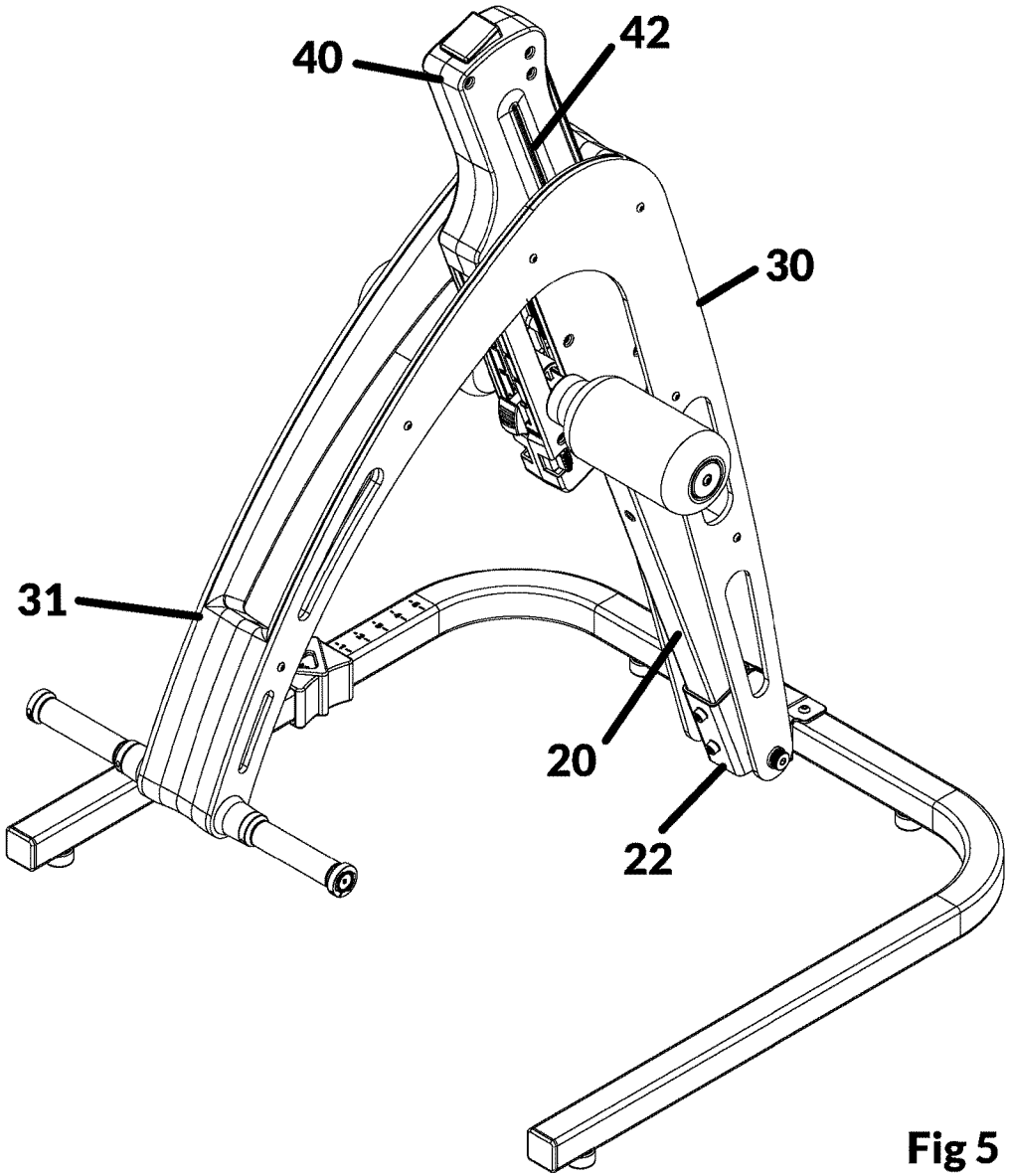
FIG. 5 is a perspective view of a preferred embodiment in an up or engaged position.
Figure 6:
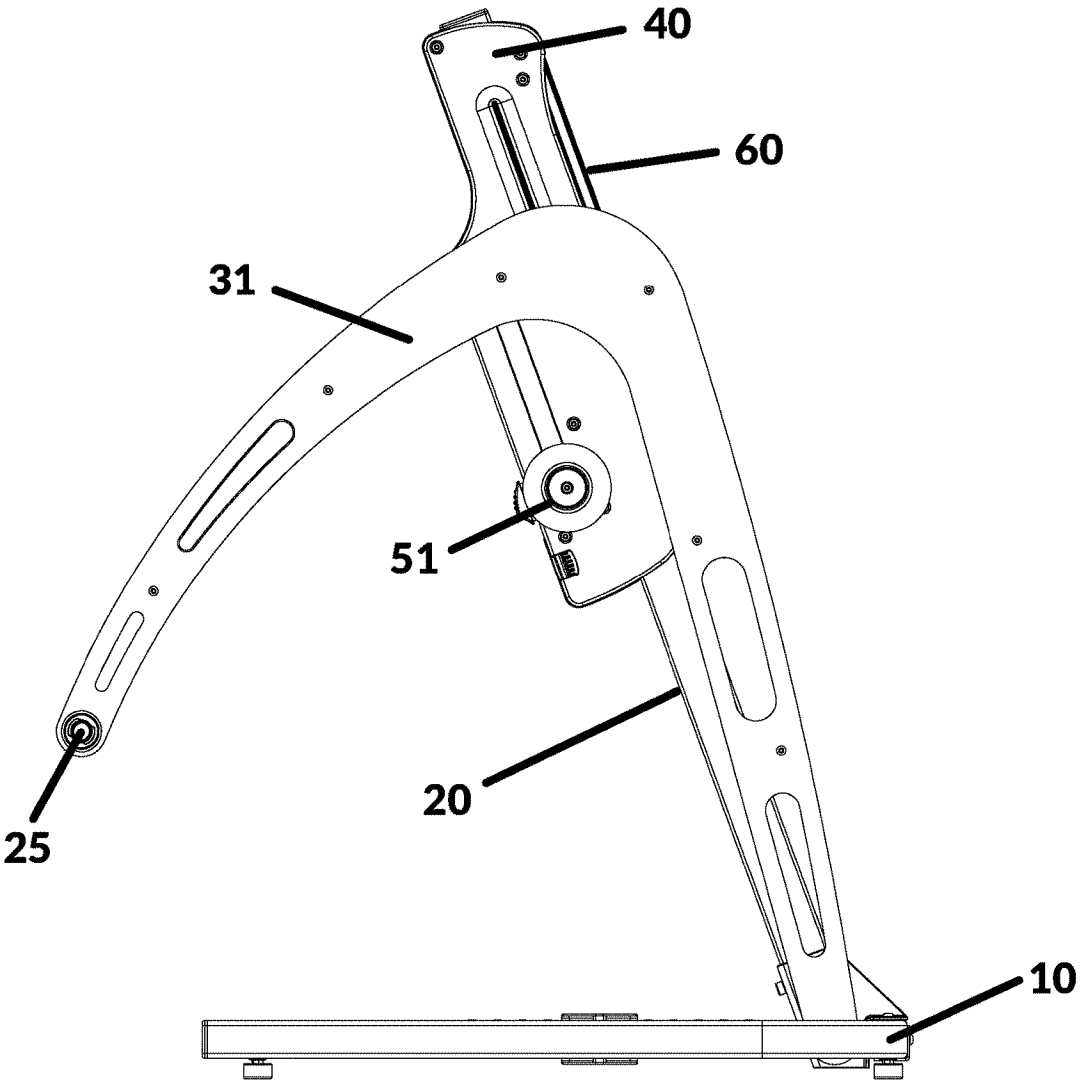
FIG. 6 is a side view of the embodiment in FIG. 5.
Figure 7:
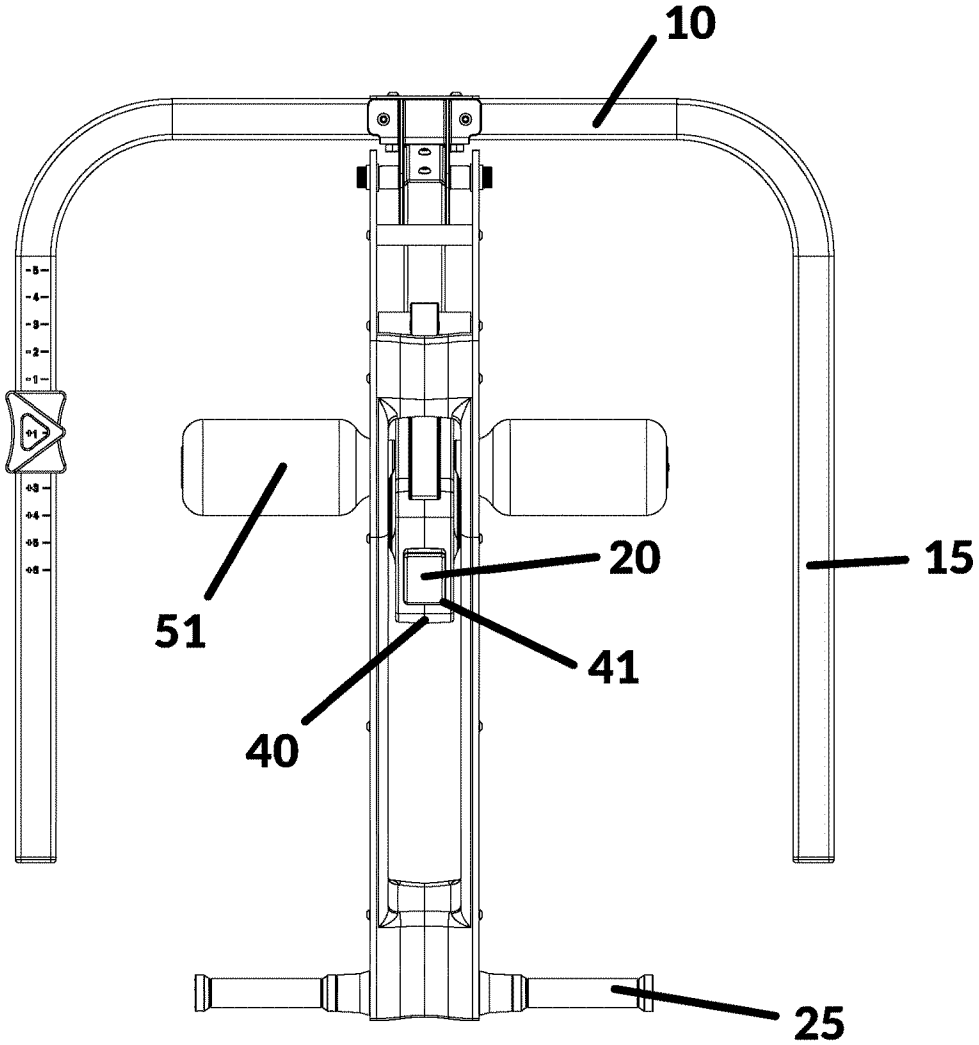
FIG. 7 is a top view of the embodiment in FIG. 5.
Figure 8:
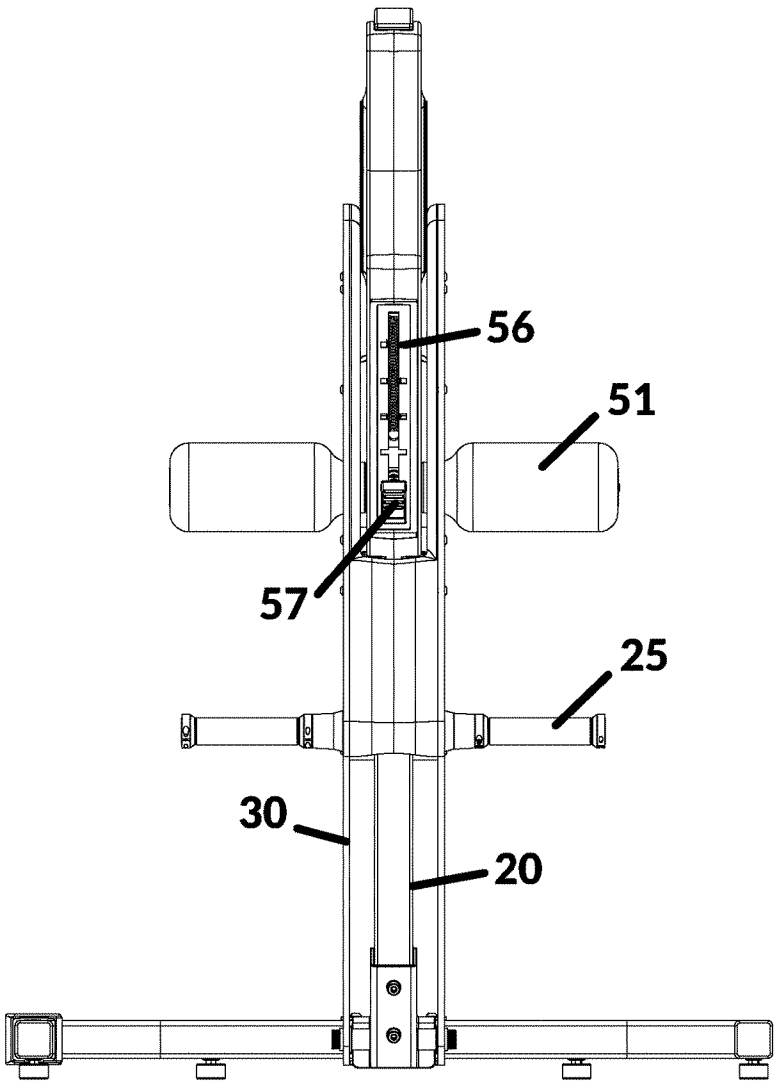
FIG. 8 is a front view of the embodiment in FIG. 5.

The invention is an exercise device that consists of a base 10, with a fixed strut 20 extending upward therefrom. Carriage 40 is placed on fixed strut 20, capable of moving between a lower position and an upper position. Knee supports 51 are placed on either side of carriage 40, so that a user may place their knees on knee supports 51 in order to use the exercise device.

Base 10 supports the entire mechanism. Preferably, base 10 includes base legs 15 for stability and independent use. As shown in the figures, base legs 15 form a U-shape, but alternate shapes including a V-shape, H-shape, or X-shape may be provided. In an alternate embodiment, base 10 may be fixed to a table or bench. An optional feature is guide 110, which provides a user with guidance as to proper placement of the user's body while using the exercise device.

Fixed strut 20 extends upward from base 10. Fixed strut 20 preferably is angled at 75 degrees from the floor or base 10, and does not move or change angle during use of the exercise device. Fixed strut 20 may be at an angle between 65 and 85 degrees, with similar functionality. Fixed strut 20 may have any cross-section geometry, but is preferably a quadrilateral to reduce or prevent lateral or rotational movement of carriage 40. Fixed strut 20 may either be attached directly to base 10, or for ease of assembly, socket 22 may be attached to base 10, allowing for the placement of a lower end of fixed strut 20 to be inserted therein. The removal of fixed strut 20 from socket 22 or base 10 allows for the exercise device to be taken apart for storage or transport.

Carriage 40 has a central cavity 41 allowing for carriage 40 to be placed on fixed strut 20, with fixed strut 20 inserted into central cavity 41. Central cavity 41 preferably has a compatible cross-section with fixed strut 20, so that lateral or rotational movement of carriage 40 is prevented or reduced. Knee support 50 is attached to carriage 40, with knee support bolsters 51 extending outward on the sides of carriage 40. Preferably, carriage track 45 is provided on carriage 40, with a plurality of positions 56 for the location of knee support 50. Carriage lock 57 secures knee support 50 in a given position 56.

Preferably, carriage height adjustment 56 and carriage lock 57 are part of carriage 40, and provide for adjusting the height of knee support 50, to allow for varying heights and leg sizes of users.

In use, carriage 40 moves along a length of fixed strut 20, from a lower position to an upper position, where the movement of carriage 40 causes knee support 50 to move with carriage 40. When a user's knees are placed over knee support bolsters 51, the upward movement of carriage 40 causes the desired movement and flexion of the lower back.

Carriage 40 may be moved by any number of means, including manually moved by another person, or by a motor. As discussed below, the preferred embodiment provides a means for a user to cause the movement of carriage 40 while using the exercise device.

In a preferred embodiment, pivoting arm 30 is attached to base 10 at pivot point 12. Pivot point 12 is preferably near where fixed strut 20 is attached to base 10. Pivoting arm 30 is free to move in a plane common to fixed strut 20, and preferably orthogonal to base 10. Pivoting arm 30 is elongated, with one end attached at pivot point 12. At the opposite end of pivoting arm 30, a first end of pulldown arm 31 is attached. Pulldown arm 31 extends toward carriage 40, and a second end of pulldown arm 31 extends past carriage 40. Preferably pulldown arm 31 comprises two parallel side panels 34 and 36, with space 35 in between parallel side panels 34 and 36. Space 35 is preferably wide enough that carriage 40 may fit therein.

To reduce friction, carriage rib 42 may be added to the sides of carriage 40 to limit the contact between carriage 40 and parallel side panels 34 and 36 of pulldown arm 31. Carriage rib 42 may be comprised of a material with a low coefficient of friction, such as the Teflon® polymer, to allow the movement of the carriage relative to the pulldown arm to be smooth and easy for the user.

At the second end of pulldown arm 31, handle 25 is placed. Handle 25 is mounted at the end of the pulldown arm 31 for the user to hold and use in operating the exercise device to produce the intended therapeutic movement.

Link 60 is attached at one end to pivot arm hinge 61 on pivoting arm 30, and extends so that a second end of link 60 is attached to carriage hinge 62 on carriage 40. As pivoting arm 30 moves toward fixed strut 20, link 60 translates the lateral movement of pivoting arm 30 into upward movement of the carriage 40.

FIGS. 1-4 show the exercise device in a first position, with the carriage 40 in a lower position.

FIGS. 5-8 show the exercise device in a second position, with the carriage 40 in an upper position.

Figure 9:
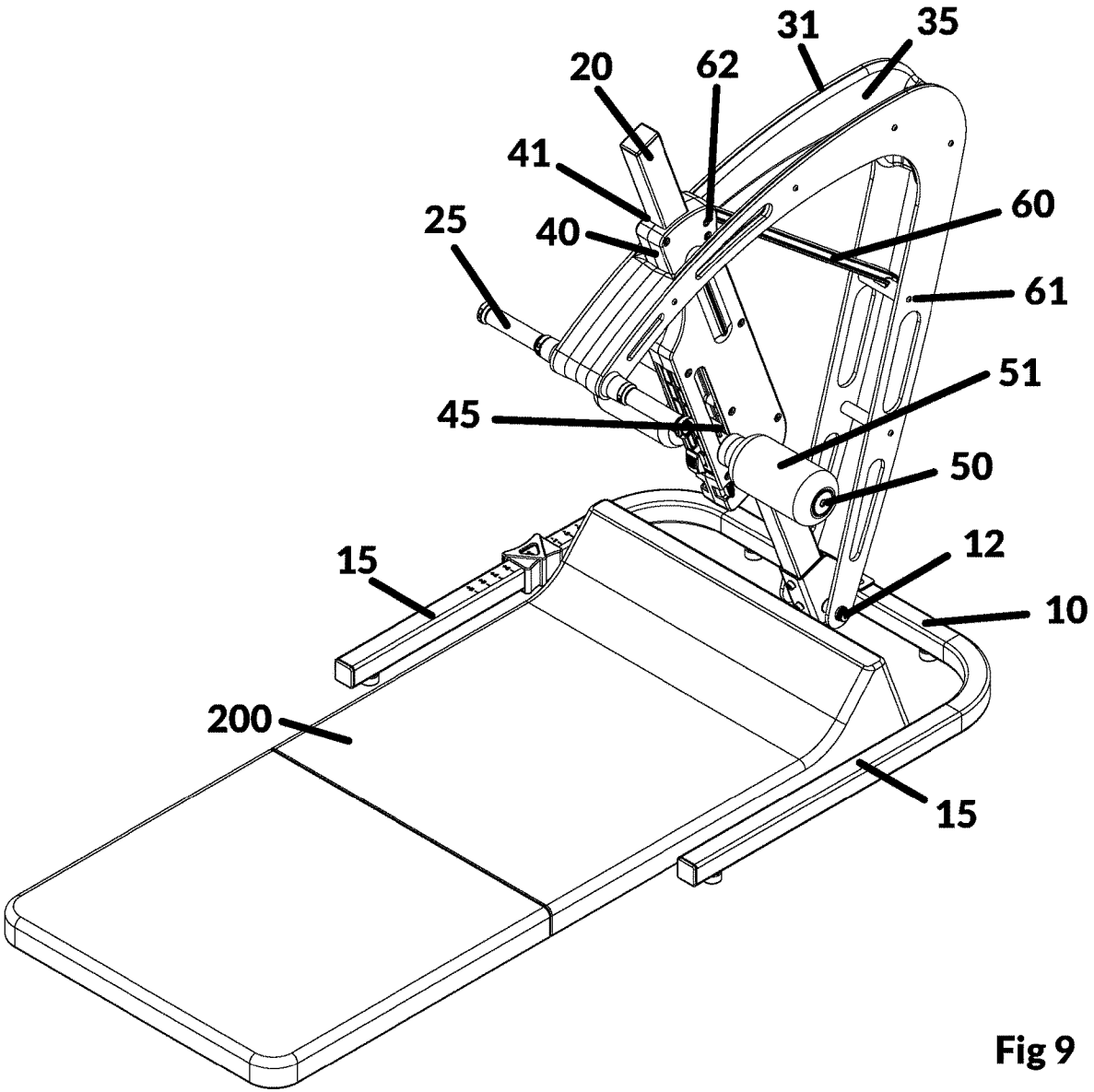
FIG. 9 is a perspective view of a preferred embodiment with an optional pad.

As shown in FIG. 9, an optional padded mat 200 may be placed within base legs 15, which could be substituted with a well carpeted floor.

Figure 10:
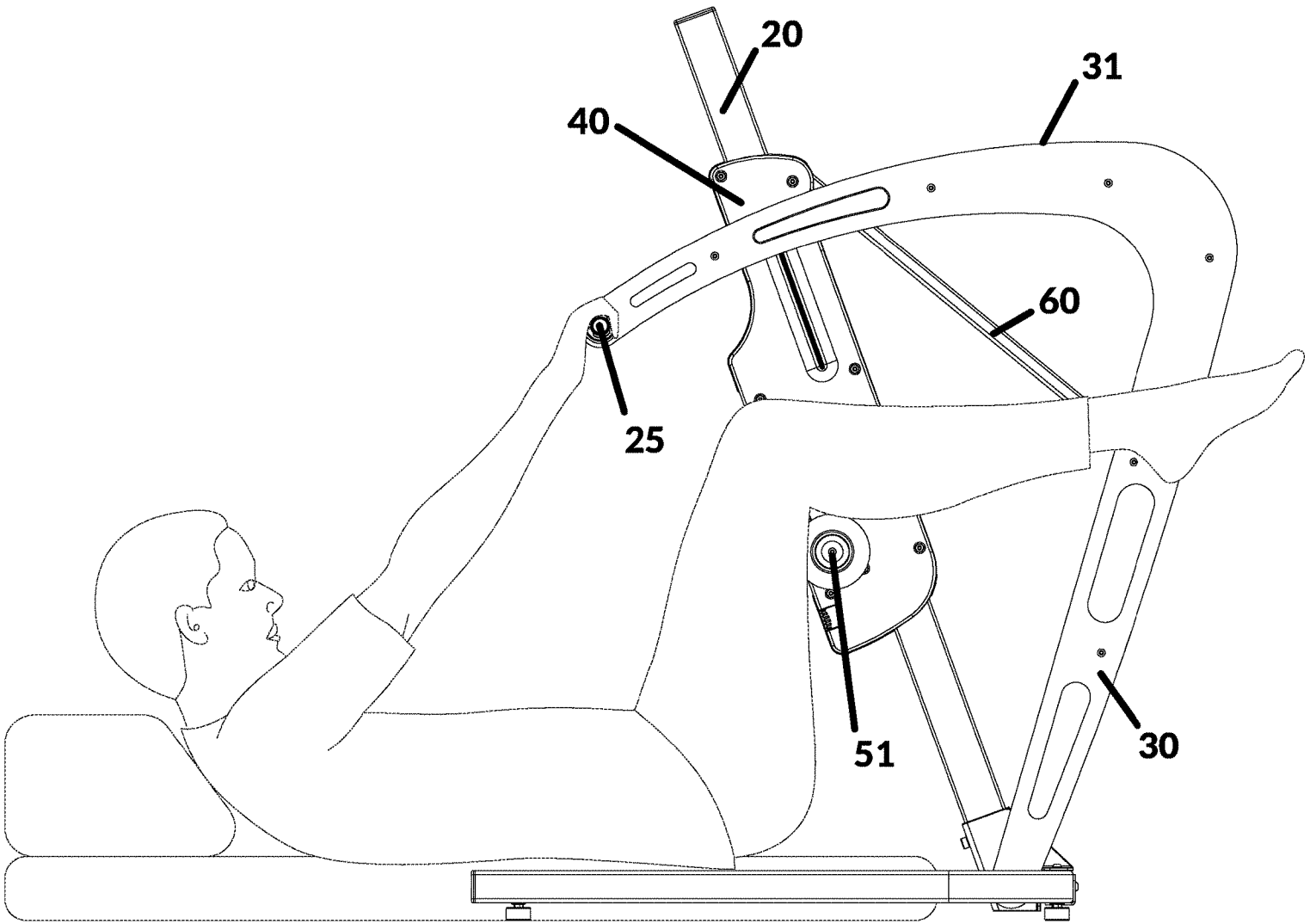
FIG. 10 is a side view of a preferred embodiment in an up position, showing the placement of a user.

FIG. 10 illustrates the user in a rested starting position for use, lying supine with the hips, hips and pelvis positioned beneath knee support 50, the knees elevated and flexed over the bolster 51, and the hands holding the handle 25 with the arms extended. The position of the device in FIG. 10 is similar to that depicted in FIGS. 1-4.

Figure 11:
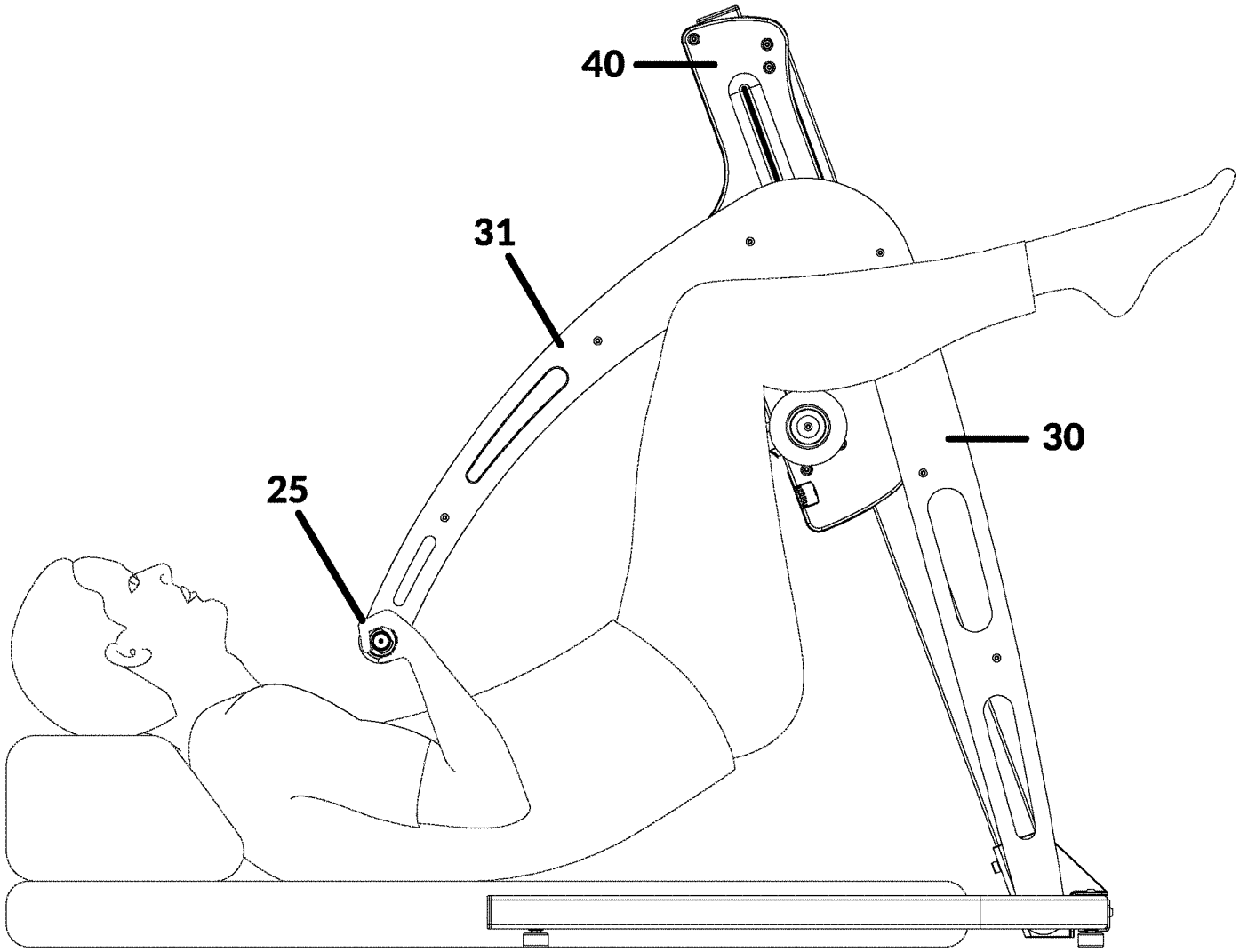
FIG. 11 is side view of a preferred embodiment in a down position, showing the placement of a user.
Figure 12:
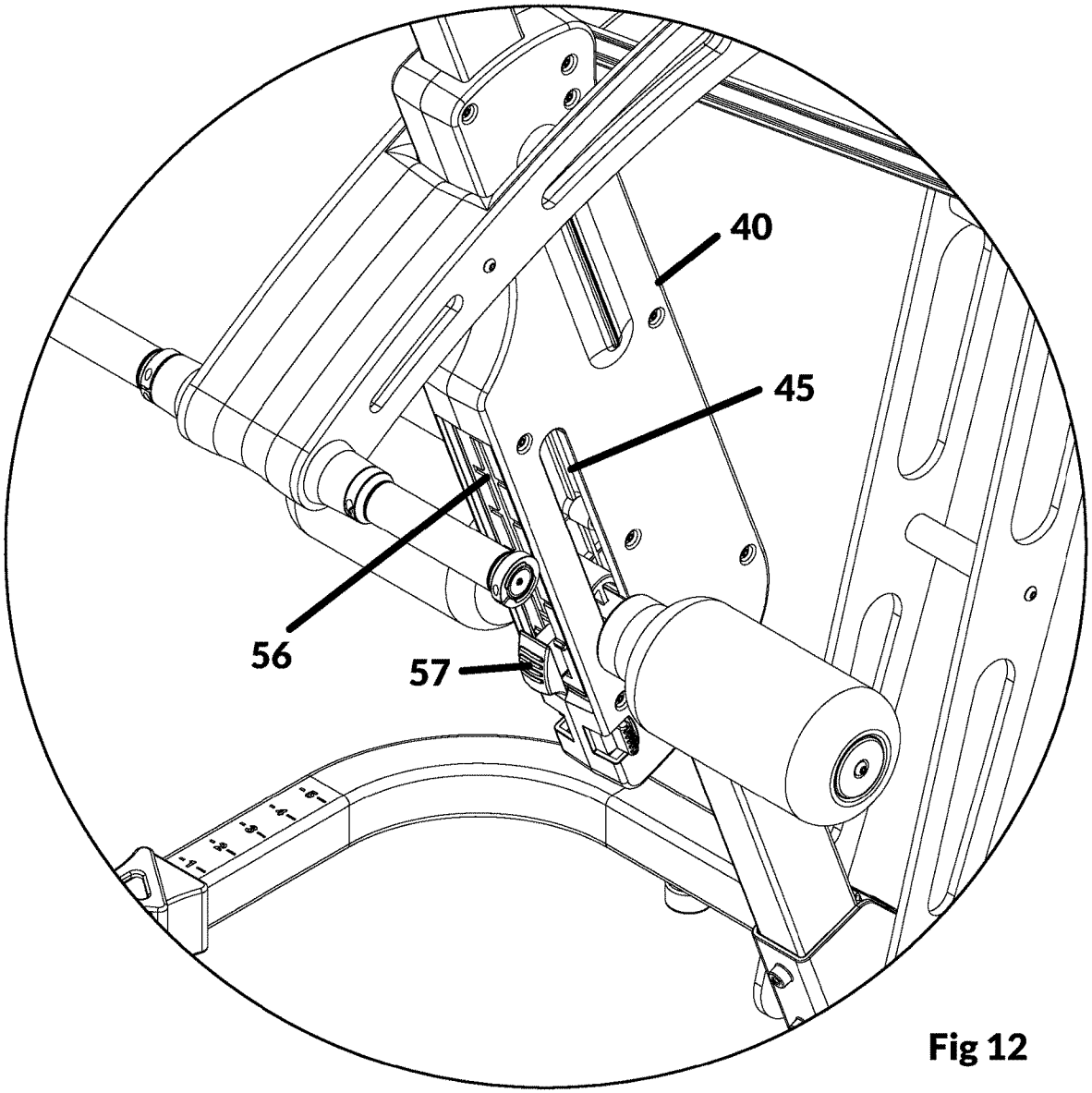
FIG. 12 is a perspective view of the carriage of the present invention.
Figure 13:
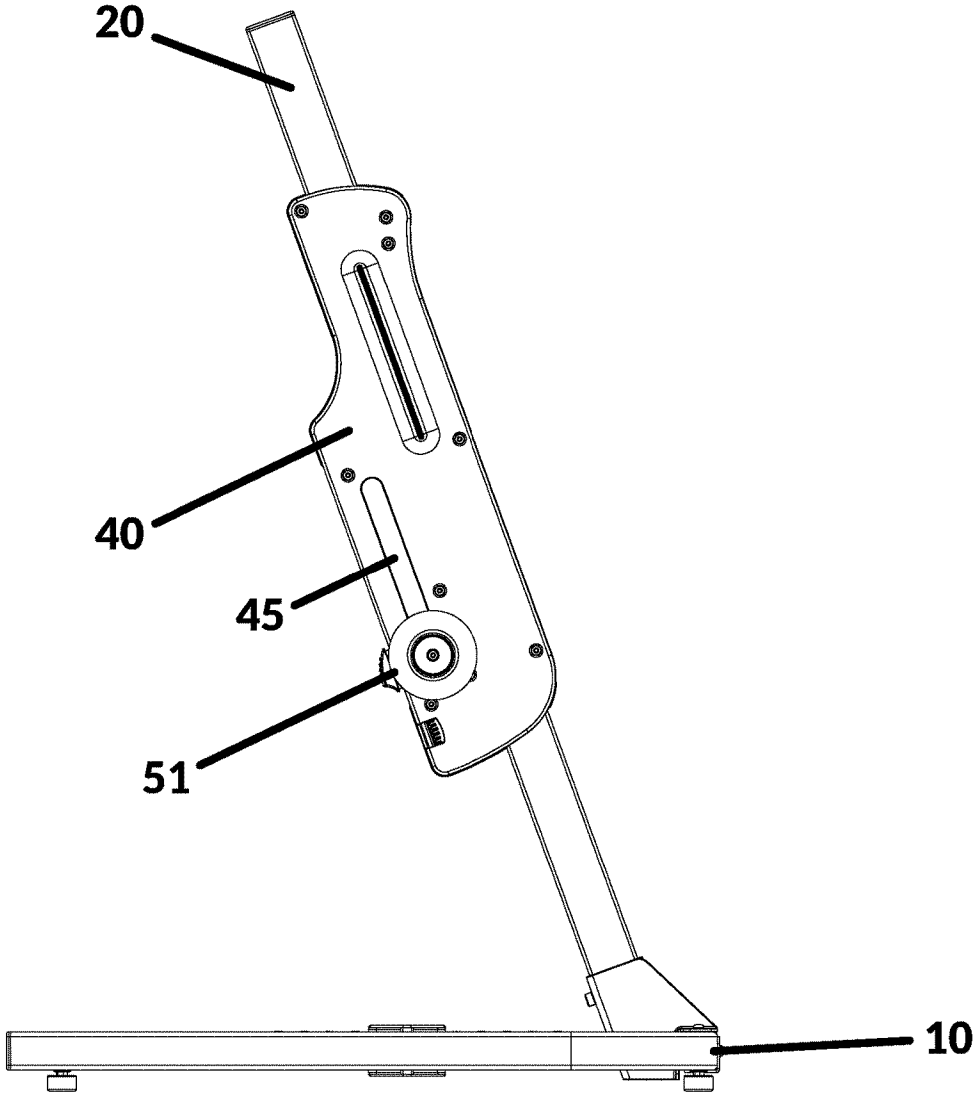
FIG. 13 is a side view of an alternate embodiment of the invention.

FIG. 11 illustrates the user with the arms and hands pulling the handle 25 downward toward the chest, resulting in the pivoting arm 30 moving toward the user and toward fixed strut 20, causing link 60 to push the carriage 40 upward along fixed strut 20. As carriage 40 moves upward, this movement lifts knee bolster 51, which in turn lifts the user's hips and pelvis and tractions the lumbar spine, while at the same time producing flexion of the lumbar spinal segments. The position of the device in FIG. 11 is similar to that depicted in FIGS. 5-8.

In use, the user lies supine on a well carpeted floor or mat 200, positioning herself/himself inside the base legs 15 with his hips and pelvis positioned directly beneath the knee support 50. The user then elevates her/his legs to place bent knees over knee support bolsters 51, with their hips and pelvis beneath knee support 50. Knee support 50 may be adjusted up or down by disengaging the carriage lock 57 and adjusting to one of the height adjustment positions available within carriage track 45. Once positioned comfortably, the user then places his hands on the handles 25 on either side of the pulldown arm 31. The user then pulls the handle 25 down to her/his chest. This motion causes the pivoting arm 30 to move toward the user, which in turn causes link 60 at hinge 61 to move toward the user. The movement of link 60 causes carriage 40 to rise upward on elongated fixed strut 20. The rise of carriage 40 causes the user's hips and pelvis to rise vis a vis the knees resting on knee bolster 51, producing a flexion of the lower back, as shown in FIG. 11. The upward movement of the hips and pelvis produces a distraction of the lumbar spinal segments, due to inversion. This action may be static as the user may keep the handle 25 depressed, held against the chest with very little effort, or it may be dynamic with the user alternately pulling and releasing the handle 25, producing an alternating opening and closing of the lumbar discs, combined with flexion, resulting in an assisted osmotic ingress of oxygenated blood and nutrients into the nucleus and annular ring of the disc.

While certain novel features of the present invention have been shown and described, it will be understood that various omissions, substitutions and changes in the forms and details of the device illustrated and in its operation can be made by those skilled in the art without departing from the spirit of the invention.

I claim:

1. An apparatus for performing flexion and distraction of the lumbar vertebrae, the apparatus comprising:

a base with an upper surface;

an elongated fixed strut with an upper end and a lower end, the lower end attached to the upper surface of the base, the elongated fixed strut extending upward from the base at an angle between 65 and 85 degrees;

a carriage supported on the elongated fixed strut, the carriage capable of movement along the elongated fixed strut;

a pivot point on the upper surface of the base;

a pivoting arm extending upward from the upper surface, the pivoting arm having an upper end and a lower end, where the lower end is attached to the pivot point on the upper surface, and where the pivoting arm is capable of rotational movement around the pivot point in a plane orthogonal to the base, where such rotational movement causes the pivoting arm to move toward or away from the elongated fixed strut;

a link having a first end and a second end, where the first end is connected to the pivoting arm between the upper and lower ends thereof, and the second end connected to the carriage;

where as the pivoting arm rotates around the pivot point, the link causes the carriage to move along the elongated fixed strut; and a knee support attached to carriage.

2. The apparatus of claim 1, further comprising:

a pulldown arm with a first end and a second end, the first end connected to the upper end of the pivot arm.

3. The apparatus of claim 2, where the pulldown arm further comprises:

a first side panel and a second side panel, with a channel formed between the first and second side panels, where the channel is capable of allowing the carriage to move freely therein.

4. The apparatus of claim 2, further comprising:

a handle on the second end of the pulldown arm.

5. The apparatus of claim 1, where the carriage further comprises:

adjustable points of attachment for the knee support, allowing for a plurality of positions for the knee support.

6. The apparatus of claim 1, where the base further comprises:

a U-shape with a cross bar connecting a right side arm and a left side arm, where the pivot point is located on an upper surface of the cross bar between the right side and left side arms.

7. An apparatus for performing flexion and distraction of the lumbar vertebrae, the apparatus comprising:

a base with an upper surface, the upper surface having a pivot point;

an elongated fixed strut attached to the upper surface of the base, the elongated fixed strut extending upward from the base at an angle between 65 and 85 degrees;

a carriage supported on the elongated fixed strut, the carriage capable of movement along the elongated fixed strut, the carriage comprising a knee support;

a pivoting arm extending upward from the upper surface, the pivoting arm having an upper end and a lower end, where the lower end is attached to the pivot point on the upper surface, and where the pivoting arm is capable of rotational movement around the pivot point in a plane orthogonal to the base, where such rotational movement causes the pivoting arm to move toward or away from the elongated fixed strut;

a link having a first end and a second end, where the first end is connected to the pivoting arm between the upper and lower ends thereof, and the second end connected to the carriage;

where as the pivoting arm rotates around the pivot point, the link causes the carriage to move along the elongated fixed strut;

a pulldown arm with a first end and a second end, the first end connected to the upper end of the pivot arm, and a first side panel and a second side panel, with a channel formed between the first and second side panels, where the carriage is capable of movement within the channel of the pulldown arm; and a handle on the second end of the pulldown arm.

8. A method for performing flexion and distraction of the lumbar vertebrae on the apparatus of claim 7, the method comprising:

having a user lie on their back and place their knees over the knee support, positioning their hips and pelvis beneath the knee support;

having the user grasp the handle; and where by pulling the handle downward toward the user, the handle causes the pulldown arm to move the pivot arm toward the user, which in turn causes the link to urge the carriage upward along the fixed strut, thereby lifting the user's knees upward, which in turn lifts the user's hips and pelvis and tractions the lumbar spine, while at the same time producing flexion of the lumbar vertebrae.

* * * * *